US010546707B2

(12) United States Patent
Kubono et al.

(10) Patent No.: US 10,546,707 B2
(45) Date of Patent: Jan. 28, 2020

(54) ELECTROMAGNETIC RELAY

(71) Applicant: FUJITSU COMPONENT LIMITED, Tokyo (JP)

(72) Inventors: Kazuo Kubono, Tokyo (JP); Takuji Murakoshi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 155 days.

(21) Appl. No.: 15/705,408

(22) Filed: Sep. 15, 2017

(65) Prior Publication Data

US 2018/0130625 A1 May 10, 2018

(30) Foreign Application Priority Data

Nov. 4, 2016 (JP) ..... 2016-216653

(51) Int. Cl.
*H01H 3/00* (2006.01)
*H01H 50/56* (2006.01)
(Continued)

(52) U.S. Cl.
CPC ..... *H01H 50/56* (2013.01); *H01H 50/26* (2013.01); *H01H 50/64* (2013.01); *H01H 9/443* (2013.01)

(58) Field of Classification Search
CPC ..... H01H 50/02; H01H 50/22; H01H 50/64; H01H 50/56; H01H 50/36; H01H 50/58;
(Continued)

(56) References Cited

U.S. PATENT DOCUMENTS 3,753,178 A * 8/1973 Kato ..... H01H 50/36 335/135
4,346,359 A * 8/1982 Pirner ..... H01H 51/06 335/128
(Continued)

FOREIGN PATENT DOCUMENTS

CN 1835162 A 9/2006
EP 2 924 704 A1 9/2015
(Continued)

OTHER PUBLICATIONS

J-PlatPat English Abstract for JP 2015-018763, published Jan. 29, 2015.
(Continued)

*Primary Examiner* — Shawki S Ismail
*Assistant Examiner* — Lisa N Homza
(74) *Attorney, Agent, or Firm* — Staas & Halsey LLP

(57) ABSTRACT

An electromagnetic relay including: a fixed terminal that includes a fixed contact; a movable spring that includes a movable piece on which a first through-hole is formed; a conductive plate that includes a second through-hole; a movable contact that includes a head part that is in contact with and is separated from the fixed contact, and a leg part that is inserted into the first through-hole and the second through-hole; wherein the conductive plate is disposed between the head part and the movable spring, in a radial direction of the first through-hole and the second through-hole, the head part does not protrude from an outer edge of the conductive plate but protrudes from the outer edge of the movable piece.

6 Claims, 10 Drawing Sheets

(51) Int. Cl.
*H01H 50/26* (2006.01)
*H01H 50/64* (2006.01)
*H01H 9/44* (2006.01)

(58) Field of Classification Search
CPC ..... H01H 50/42; H01H 50/28; H01H 50/646; H01H 51/2281
USPC ..... 335/189
See application file for complete search history.

(56) References Cited

U.S. PATENT DOCUMENTS 4,439,750 A * 3/1984 Fujii ..... H01F 7/08 335/274
5,041,870 A * 8/1991 Imai ..... H01H 50/042 335/202
5,191,306 A * 3/1993 Kaji ..... H01H 50/16 335/128
5,289,144 A * 2/1994 Liao ..... H01H 50/041 335/78
5,396,204 A * 3/1995 Matsuoka ..... H01H 50/04 335/78
5,790,004 A * 8/1998 Matsuoka ..... H01H 50/042 335/78
6,211,761 B1 * 4/2001 Yoshino ..... H01H 50/023 335/282
7,750,769 B2 * 7/2010 Minowa ..... H01H 50/56 335/128
7,782,162 B2 * 8/2010 Nishida ..... H01H 50/56 335/201
8,222,979 B2 * 7/2012 Minowa ..... H01H 50/36 335/129
8,274,344 B2 * 9/2012 Kato ..... H01F 7/127 335/78
8,659,372 B2 * 2/2014 Morimura ..... H01H 50/02 335/201
8,816,800 B2 * 8/2014 Mikl ..... H01H 50/56 335/83
9,859,078 B2 * 1/2018 Kubono ..... H01H 1/26
9,865,420 B2 * 1/2018 Kubono ..... H01H 50/26
10,242,829 B2 * 3/2019 Hasegawa ..... H01H 50/38
2003/0112103 A1 * 6/2003 Schmelz ..... H01H 1/26 335/128
2006/0181380 A1 * 8/2006 Nakamura ..... H01H 50/043 335/132
2009/0115557 A1 * 5/2009 Minowa ..... H01H 50/28 335/189
2013/0057370 A1 * 3/2013 Kubono ..... H01H 50/643 335/177
2014/0015628 A1 * 1/2014 Shinkai ..... H01H 51/06 335/189
2015/0042425 A1 * 2/2015 Sumino ..... H01H 50/643 335/189
2015/0279600 A1 * 10/2015 Hiraiwa ..... H01H 50/546 335/189
2016/0027602 A1 * 1/2016 Hasegawa ..... H01H 50/58 335/189
2016/0314920 A1 10/2016 Aratani
2017/0345597 A1 11/2017 Sasaki et al.
2018/0096810 A1 * 4/2018 Murakoshi ..... H01H 50/02
2018/0130625 A1 * 5/2018 Kubono ..... H01H 50/56
2019/0006139 A1 * 1/2019 Murakoshi ..... H01H 50/28

FOREIGN PATENT DOCUMENTS

EP 3021340 5/2016
JP 02-148543 6/1990
JP 4258361 2/2009
JP 2012-094294 5/2012
JP 2015-018763 1/2015
JP 2015-115248 6/2015
JP 2015-191857 11/2015
WO WO 2016/152443 A1 9/2016

OTHER PUBLICATIONS

J-PlatPat English Abstract for JP 02-148543, published Jun. 7, 1990.
J-PlatPat English Abstract for JP 2012-094294, published May 17, 2012.
J-PlatPat English Abstract for JP 2015-191857, published Nov. 2, 2015.
Patentscope English abstract for International Publication No. 2016/152443 A1, dated Sep. 29, 2016.
Espacenet English abstract for Chinese Patent Publication No. 1835162 A, dated Sep. 20, 2006.
Chinese Office Action dated Nov. 28, 2018 in corresponding Chinese Patent Application No. 201711024633.6.
Chinese Office Action dated Jul. 19, 2019 in application No. 2017-11024633.6.

* cited by examiner

ELECTROMAGNETIC RELAY

CROSS-REFERENCE TO RELATED APPLICATION

This application is based upon and claims the benefit of priority of the prior Japanese Patent Application No. 2016-216653 filed on Nov. 4, 2016, the entire contents of which are incorporated herein by reference.

FIELD

A certain aspect of the embodiments is related to an electromagnetic relay.

BACKGROUND

There has been conventionally known an electromagnetic relay that fixes movable contacts to a movable spring and a conductive support member in order to increase a current-carrying capacity (see Patent Document 1: Japanese Laid-open Patent Publication No. 2015-191857). Moreover, there has been known an electromagnetic relay that increases a current-carrying capacity by overlapping multiple conductive plates (see Patent Document 2: Japanese Laid-open Patent Publication No. 2015-18763).

SUMMARY

According to an aspect of the present invention, there is provided an electromagnetic relay including: a fixed terminal that includes a fixed contact; a movable spring that includes a movable piece on which a first through-hole is formed; a conductive plate that includes a second through-hole; a movable contact that includes a head part that is in contact with and is separated from the fixed contact, and a leg part that is inserted into the first through-hole and the second through-hole; wherein the conductive plate is disposed between the head part and the movable spring, in a radial direction of the first through-hole and the second through-hole, the head part does not protrude from an outer edge of the conductive plate but protrudes from the outer edge of the movable piece.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the case of increasing the current-carrying capacity, a current applied to a contact is increased and the heat generated by the contact is increased, it is therefore necessary to increase the size of the contact. However, depending on the size of the movable spring or conductive plate, the contact protrudes from the movable spring or the conductive plate when the size of the contact is increased. When the contacts protrudes from the movable spring or conductive plate, there is a problem that it is not possible to efficiently convey the current and the heat from the contact to the movable spring or the conductive plate.

A description will now be given of an embodiment according to the present invention with reference to drawings.

Figure 1:
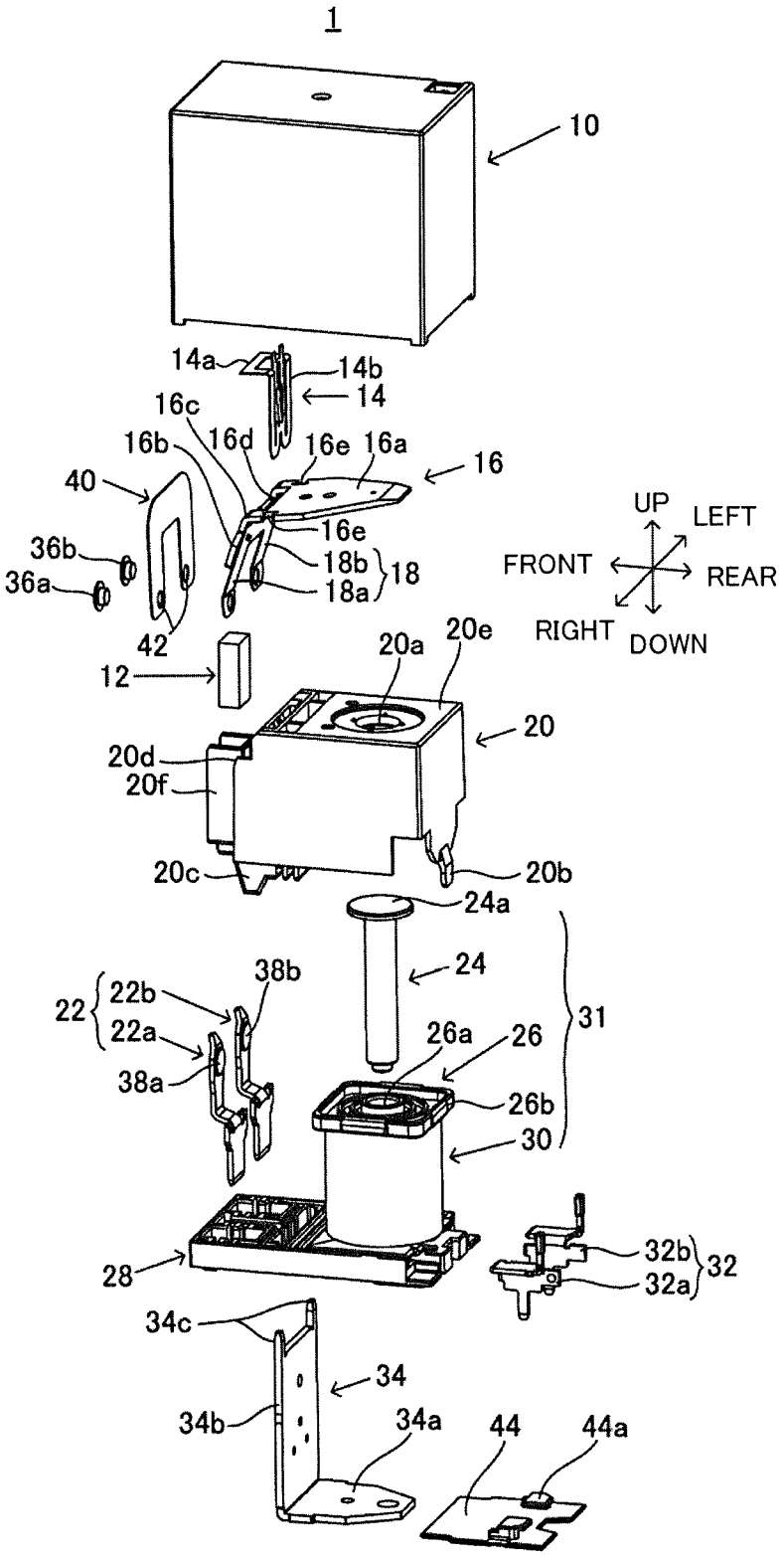
FIG. 1 is an exploded view of an electromagnetic relay (hereinafter referred to as "a relay") 1 according to a present embodiment.
Figure 2:
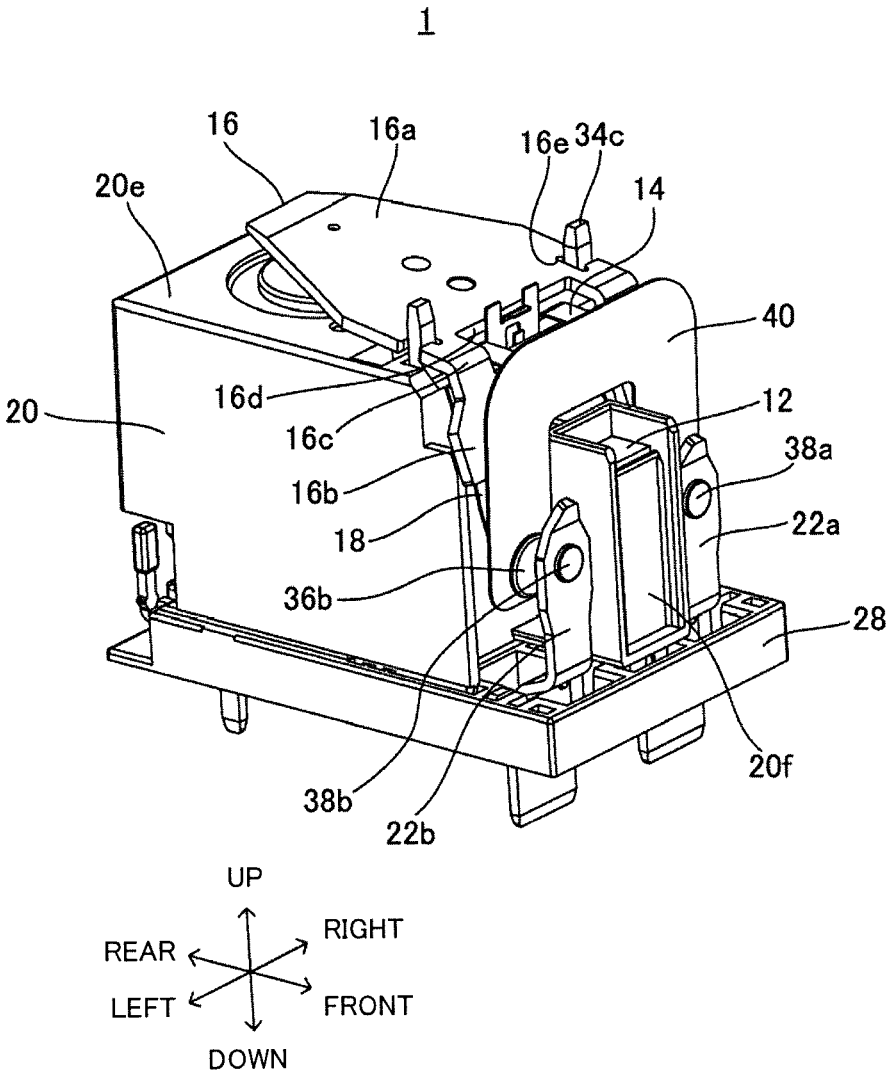
FIG. 2 is a perspective view of the relay 1.

FIG. 1 is an exploded view of an electromagnetic relay (hereinafter referred to as "a relay") according to a present embodiment. FIG. 2 is a perspective view of the relay.

A relay 1 according to the present embodiment is a relay adaptable to a high voltage, and is used as a relay for battery pre-charge of an electric vehicle (i.e., a relay for prevention of an inrush current to a main relay contact), for example.

When a high voltage load is shut off, the relay 1 is required to reliably extinguish an arc generated between a fixed contact and a movable contact. In a general DC high voltage relay, a polarity is designated for connection of a load side. On the other hand, in the relay 1 for the battery pre-charge, a direction of a current is reversed at the time of battery charging and discharging, and it is therefore required not to designate the polarity of the connection of the load side. Therefore, the relay 1 needs to extinguish the arc regardless of the direction of the current flowing between the movable contact and the fixed contact. Here, an application of the relay 1 is not limited to the electric vehicle, and the relay 1 can be used in various devices and equipment.

As illustrated in FIG. 1, the relay 1 includes a case 10, a permanent magnet 12 for arc-extinguishing, a hinge spring 14, an armature 16, a movable spring 18, a conductive plate 40, an insulating cover 20, fixed terminals 22 (22*a*, 22*b*), an iron core 24, a spool 26, a base 28, a coil 30, a pair of coil terminals 32 (32*a*, 32*b*), a yoke 34, and a fixed plate 44. The pair of coil terminals 32 supplies a current for excitation of an electromagnet device 31 having the iron core 24, the spool 26 and the coil 30.

A magnet holder 20*f* is formed on a front end of the insulating cover 20, and the permanent magnet 12 is held in the magnet holder 20*f*. A magnet holder 20*f* and the permanent magnet 12 are arranged between the fixed terminals 22*a* and 22*b*, as illustrated in FIG. 2. In FIG. 2, the case 10 is omitted. For example, a surface having an N-pole of the permanent magnet 12 is directed to the fixed terminal 22*b* side, and a surface having an S-pole of the permanent magnet 12 is directed to the fixed terminal 22*a* side. The position of the N-pole and S-pole may be reversed. Although the permanent magnet 12 is not required when an AC high voltage load is shut off, it is possible to promptly perform the arc-extinguishing by providing the permanent magnet 12.

Returning to FIG. 1, the hinge spring 14 is formed in an inverted L-shape in a side view, and includes a horizontal part 14*a* that biases downward a suspended part 16*b* of the armature 16 toward the base 28, and a suspended part 14*b* that is fixed to a vertical part 34*b* of the yoke 34.

Figure 3:
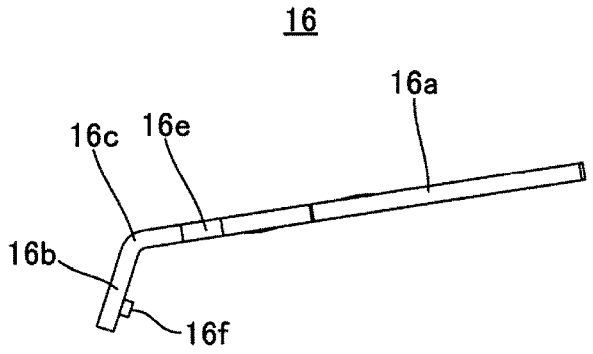
FIG. 3 is a side view of an armature 16.

The armature 16 is a magnetic body having a dogleg shape in the side view, as illustrated in FIG. 3, and includes a flat plate part 16*a* that is attracted to the iron core 24, and the suspended part 16*b* that extends downward from the flat plate part 16*a* via a bending part 16*c*. Moreover, a through-hole 16*d* from which the hinge spring 14 protrudes is formed in the center of the bending part 16*c*, as illustrated in FIGS. 1 and 2. Moreover, cutout parts 16*e* in which projection parts 34*c* of the yoke 34 are fitted are formed on the flat plate part 16*a*. Projections 16*f* for fixing the movable spring 18 to the suspended part 16*b* by caulking are provided on the suspended part 16*b* (see FIG. 3).

The armature 16 rotates using the cutout parts 16*e* as a fulcrum into which the projection parts 34*c* of the yoke 34 are fitted. When the current flows into the coil 30, the iron core 24 attracts the flat plate part 16*a*. At this time, the horizontal part 14*a* of the hinge spring 14 is in contact with the suspended part 16*b*, and is pushed upward by the suspended part 16*b*. When the current of the coil 30 is cut, the suspended part 16*b* is pushed down by a restoring force of the horizontal part 14*a* of the hinge spring 14. Thereby, the flat plate part 16*a* is separated from the iron core 24. Here, a surface of the flat plate part 16*a* opposite to the iron core 24 or the insulating cover 20 is defined as a first surface, and a back side of the first surface is defined as a second surface. Moreover, a surface of the suspended part 16*b* opposite to the yoke 34 or the insulating cover 20 is defined as the first surface, and a back side of the first surface is defined as the second surface.

Figure 4A:
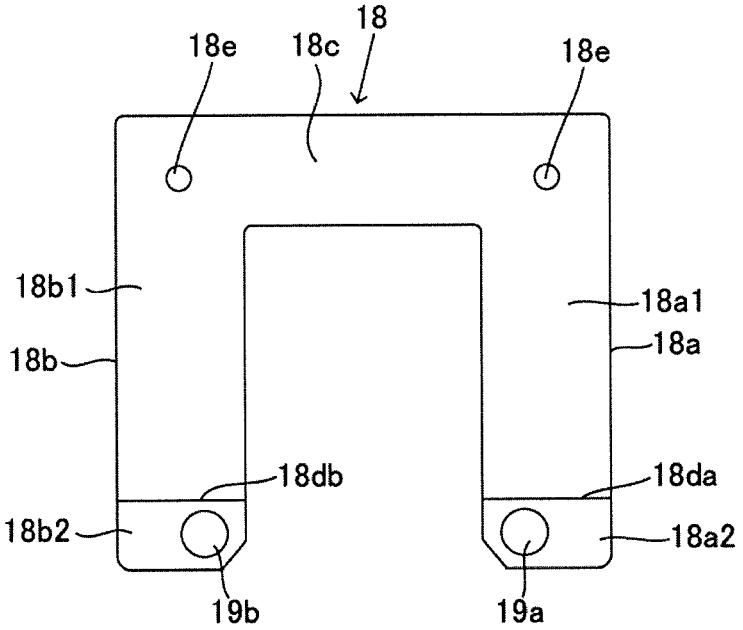
FIG. 4A is a front view of a movable spring 18.
Figure 4B:
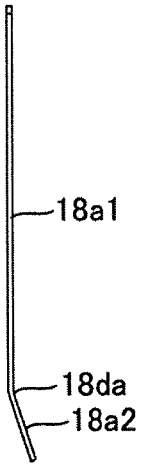
FIG. 4B is a side view of the movable spring 18.
Figure 4C:
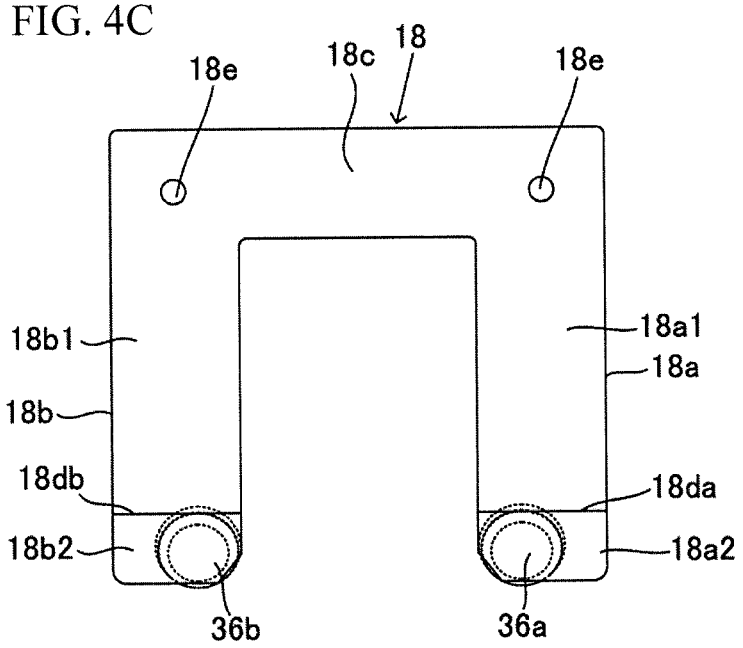
FIG. 4C is a diagram illustrating the movable spring 18 on which movable contacts 36*a* and 36*b* are mounted.
Figure 5A:
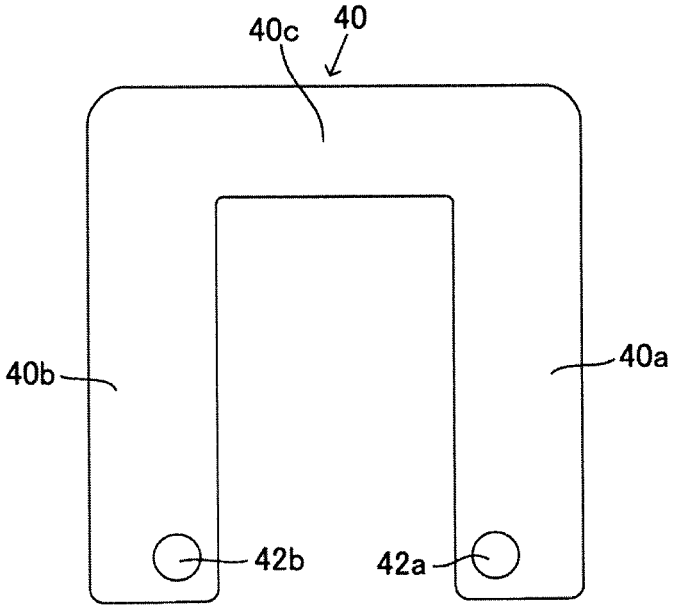
FIG. 5A is a front view of a conductive plate 40.
Figure 5B:
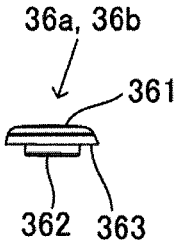
FIG. 5B is a configuration diagram of the movable contacts 36*a* and 36*b;*
Figure 5C:
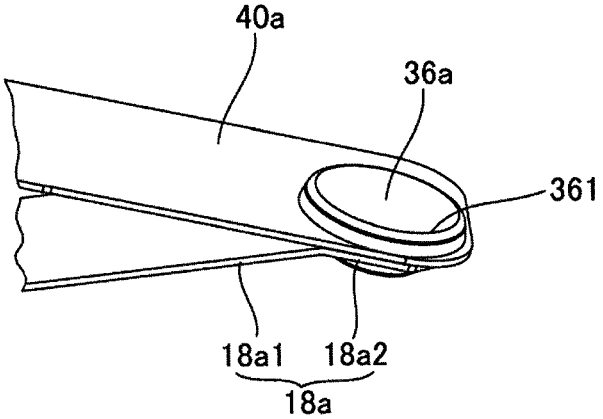
FIG. 5C is a partial enlarged view illustrating a state where the movable contact 36*a* is mounted on the movable spring 18 and the conductive plate 40.

FIG. 4A is a front view of the movable spring 18. FIG. 4B is a side view of the movable spring 18. FIG. 4C is a diagram illustrating the movable spring 18 on which movable contacts 36*a* and 36*b* are mounted. FIG. 5A is a front view of the conductive plate 40. FIG. 5B is a configuration diagram of the movable contacts 36*a* and 36*b*. FIG. 5C is a partial enlarged view illustrating a state where the movable contact 36*a* is mounted on the movable spring 18 and the conductive plate 40.

As illustrated in FIG. 4A, the movable spring 18 is a conductive plate spring having a U-shape in the front view, and is made of a copper alloy, for example. The movable spring 18 includes a pair of movable pieces, i.e., a first movable piece 18*a* and a second movable piece 18*b*, and a coupling part 18*c* that couples upper ends of the first movable piece 18*a* and the second movable piece 18*b*.

The first movable piece 18*a* and the second movable piece 18*b* are bent at positions 18*da* and 18*db* closer to lower ends than centers thereof in a longitudinal direction, respectively. Here, a part of the first movable piece 18*a* closer to the coupling part 18*c* than the position 18*da* is defined as an upper part 18*a*1, and a part of the first movable piece 18*a* closer to a tip side than the position 18*da* is defined as a lower part 18*a*2. Similarly, a part of the second movable piece 18*b* closer to the coupling part 18*c* than the position 18*db* is defined as an upper part 18*b*1, and a part of the second movable piece 18*b* closer to a tip side than the position 18*db* is defined as a lower part 18*b*2. The lower part 18*a*2 and the lower part 18*b*2 serve as flat parts that fix the movable contacts 36*a* and 36*b* thereto, respectively.

A through-hole 19*a* for fixing the movable contact 36*a* by caulking is provided on the lower part 18*a*2 of the first movable piece 18*a*. A through-hole 19*b* for fixing the movable contact 36*b* by caulking is provided on the lower part 18*b*2 of the second movable piece 18*b*. Each of the through-holes 19*a* and 19*b* serves as a first through-hole. The lower parts 18*a*2 and 18*b*2 are bent against the upper parts 18*a*1 and 18*b*1 in a direction where the movable contacts 36*a* and 36*b* are away from the fixed contacts 38*a* and 38*b*, respectively.

Through-holes 18*e* into which the projections 16*f* of the suspended part 16*b* are fitted are formed on the coupling part 18*c*. The projections 16*f* are fitted into and caulked to the through-holes 18*e*, so that the movable spring 18 is fixed to the first surface of the suspended part 16*b*.

When the movable contacts 36*a* and 36*b* are mounted on the movable spring 18, the movable contact 36*a* protrudes from the lower part 18*a*2 and the movable contact 36*b* protrudes from the lower part 18*b*2, as illustrated in FIG. 4C. In this case, the current and the heat cannot be conveyed efficiently from the movable contacts 36*a* and 36*b* to the movable spring 18.

The conductive plate 40 illustrated in FIG. 5A has a U-shape in a front view, and is made of copper, for example. The conductive plate 40 has a higher conductivity and a higher thermal conductivity than the movable spring 18. The conductive plate 40 includes a pair of leg pieces, i.e., a first leg piece 40*a* and a second leg piece 40*b*, and a coupling part 40*c* that couples upper ends of the first leg piece 40*a* and the second leg piece 40*b*. A through-hole 42*a* for fixing the movable contact 36*a* to the first movable piece 18*a* by caulking is provided on a lower end of the first leg piece 40*a*. A through-hole 42*b* for fixing the movable contact 36*b* to the second movable piece 18*b* by caulking is provided on a lower end of the second leg piece 40*b*.

The through-holes 42*a* and 42*b* serve as second through-holes into which leg parts 362 of the movable contacts 36*a* and 36*b* are inserted.

As illustrated in FIG. 5B, each of the movable contacts 36*a* and 36*b* has a rivet-like shape, and include a head part 361 that is in contact with the fixed contact 38*a* or 38*b*, and a leg part 362 that is inserted into the through-hole 19*a* or 19*b* of the movable spring 18 and the through-hole 42*a* or 42*b* of the conductive plate 40. The movable contact 36*a* is fixed to the conductive plate 40 and the movable spring 18 by caulking in a state of aligning the positions of the through-hole 19*a* and the through-hole 42*a*. The movable contact 36*b* is fixed to the conductive plate 40 and the movable spring 18 by caulking in a state of aligning the positions of the through-hole 19*b* and the through-hole 42*b*. When the movable contacts 36*a* and 36*b* are fixed to the conductive plate 40 and the movable spring 18 by caulking, a contact surface 363 of the head part 361 is in contact with the conductive plate 40.

When the movable contact 36*a* is fixed to the conductive plate 40 and the movable spring 18 by caulking as illustrated in FIG. 5C, the head part 361 of the movable contact 36*a* protrudes from an outer edge of the lower part 18*a*2 of the movable spring 18 in a radial direction of the head part 361, but is fixed so as not to protrude from an outer edge of the first leg piece 40*a* of the conductive plate 40. Similarly, when the movable contact 36*b* is fixed to the conductive plate 40 and the movable spring 18 by caulking, the head part 361 of the movable contact 36*b* is fixed so as not to protrude from an outer edge of the second leg piece 40*b* of the conductive plate 40 in the radial direction of the head part 361. Moreover, when the movable contacts 36*a* and 36*b* are fixed to the conductive plate 40 and the movable spring 18 by caulking, the conductive plate 40 is disposed between the movable spring 18 and the contact surface 363. That is, the contact surface 363 of the head part 361 is in contact with the conductive plate 40. Thus, in the present embodiment, since the conductive plate 40 is disposed between the movable spring 18 and the contact surface 363 so that the whole of the contact surface 363 is in contact with the conductive plate 40, it is possible to efficiently convey the current and the heat from the movable contacts 36*a* and 36*b* to the conductive plate 40, and increase a current-carrying capacity of the relay.

Figure 6A:
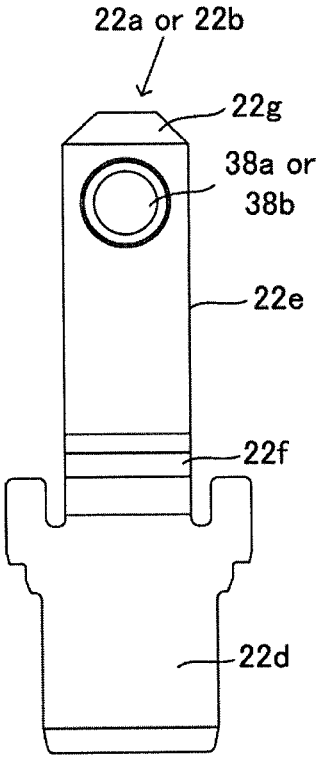
FIG. 6A is a front view of fixed terminals 22*a* and 22*b;*
Figure 6B:
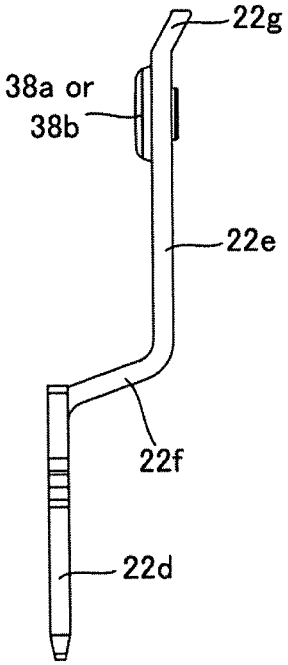
FIG. 6B is a side view of the fixed terminals 22*a* and 22*b;*

FIG. 6A is a front view of fixed terminals 22*a* and 22*b*. FIG. 6B is a side view of the fixed terminals 22*a* and 22*b*.

The fixed terminals 22*a* and 22*b* are press-fitted from above into through-holes, not shown, provided on the base 28, and are fixed to the base 28. The fixed terminals 22*a* and 22*b* are bent in a crank shape in the side view, and each of the fixed terminals 22*a* and 22*b* includes an upper part 22*e*, an inclined part 22*f* and a lower part 22*d*. The upper part 22*e* is coupled with the lower part 22*d* via the inclined part 22*f*. The upper part 22*e*, the inclined part 22*f* and the lower part 22*d* are integrally formed. The lower part 22*d* is connected to a power supply, not shown, and becomes a blade terminal to improve current-carrying performance. Since the lower part 22*d* becomes the blade terminal, the lower part 22*d* increases a contact area to the substrate compared with a forked terminal for example, thereby improving the current-carrying performance. The upper part 22*e* is bent so as to be away from the movable spring 18 and the conductive plate 40 than the lower part 22*d*. An upper end 22*g* of the upper part 22*e* is bent so as to be away from the movable spring 18 and the conductive plate 40 than other portion of the upper part 22*e*. The fixed contacts 38*a* and 38*b* are provided on the upper parts 22*e* of the fixed terminals 22*a* and 22*b*, respectively.

With reference to FIG. 1 again, the insulating cover 20 is made of resin. A ceiling part 20*e* of the insulating cover 20 has a through-hole 20*a* that exposes a head part 24*a* of the iron core 24. In order to fix the insulating cover 20 to the base 28, projection-shaped fixed parts 20*b* and 20*c* are formed on the bottom of the insulating cover 20. The fixed part 20*b* engages with one end of the base 28, and the fixed part 20*c* is inserted into a hole, not shown, of the base 28. Moreover, a backstop 20*d* made of resin is integrally formed with the insulating cover 20. When no current flows into the coil 30 and the electromagnet device 31 is turned off, the backstop 20*d* acting as a stopper is in contact with the movable spring 18. The backstop 20*d* can suppress the generation of a collision sound between metal components such as the movable spring 18 and the yoke 34, and therefore the backstop 20*d* can reduce an operation sound of the relay 1.

The iron core 24 is inserted into a through-hole 26*a* formed in a head part 26*b* of the spool 26. The spool 26 is formed integrally with the base 28 and the coil 30 is wound around the spool 26. The iron core 24, the spool 26 and the coil 30 form the electromagnetic device 31. The electromagnetic device 31 attracts the flat plate part 16*a* of the armature 16 or cancels the attraction of the flat plate part 16*a* in accordance with on/off of the current. Thereby, opening or closing operation of the movable spring 18 with respect to the fixed terminals 22*a* and 22*b* is performed. The pair of the coil terminals 32 is press-fitted into the base 28. The coil 30 is entwined with each of the coil terminals 32.

The yoke 34 is made of a conductive material having an L shape in the side view, and includes a horizontal part 34*a* to be fixed to a back surface of the base 28 and the vertical part 34*b* provided vertically to the horizontal part 34*a*. From the bottom of the base 28, the vertical part 34*b* is press-fitted into through-holes, not shown, of the base 28 and the insulating cover 20. Thereby, the projection parts 34*c* provided on both upper edges of the vertical part 34*b* project from the ceiling part 20*e* of the insulating cover 20, as illustrated in FIG. 2. The fixed plate 44 includes hook parts 44*a* for fixing the fixed plate 44 to the horizontal part 34*a*, and the fixed plate 44 is fixed to the back surface of the base 28.

Figure 7A:
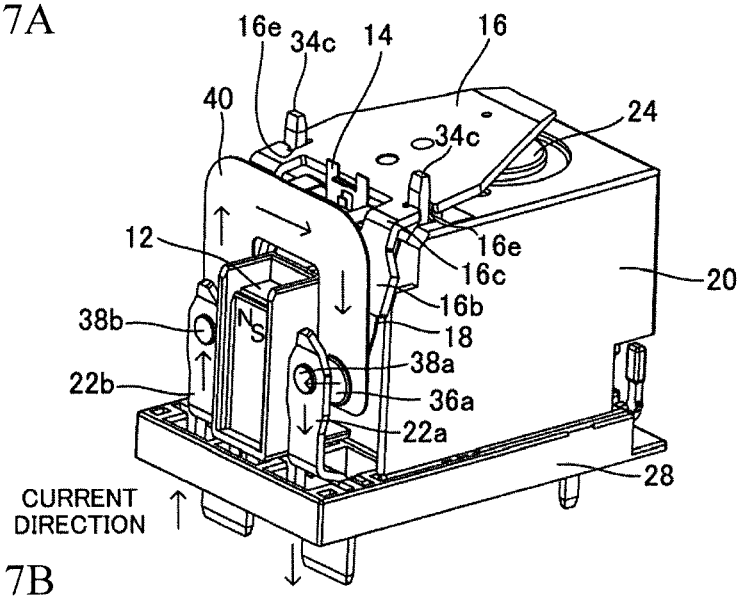
FIG. 7A is a diagram schematically illustrating a direction of a current flowing into the relay 1.
Figure 7B:
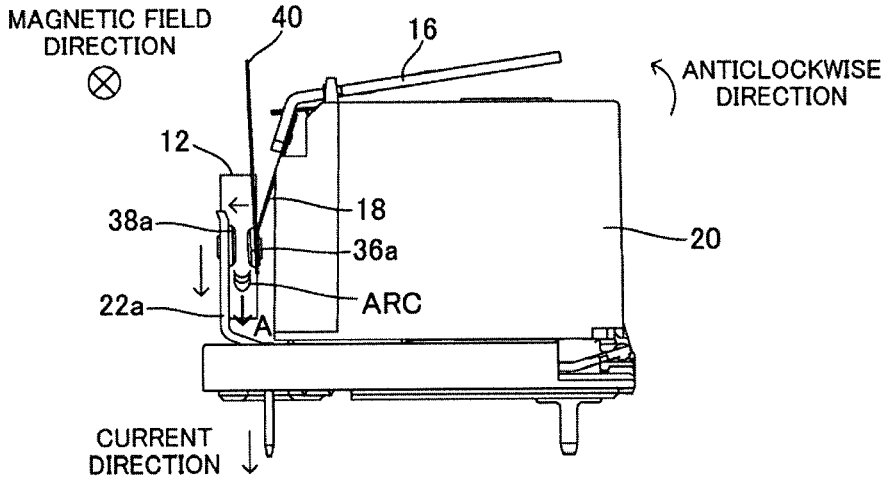
FIG. 7B is a diagram illustrating an arc-extinguishing state viewed from a fixed terminal 22*a* side.
Figure 7C:
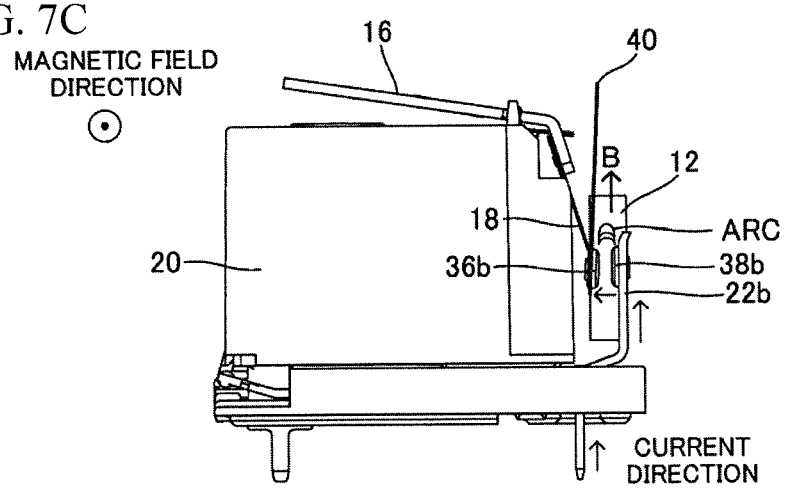
FIG. 7C is a diagram illustrating an arc-extinguishing state viewed from a fixed terminal 22*b* side.

FIG. 7A schematically illustrates the direction of the current flowing into the relay 1 and, in particular, illustrates a state where the fixed contact is away from the movable contact. FIG. 7B illustrates an arc-extinguishing state viewed from a fixed terminal 22*a* side. FIG. 7C illustrates an arc-extinguishing state viewed from a fixed terminal 22*b* side. In FIG. 7A to FIG. 7C, the direction of the current is illustrated with arrows.

In FIG. 7A, any one of the fixed terminals 22*a* and 22*b* is connected to a power supply side, not shown, and the other is connected to a load side, not shown. When the current flows in the coil 30, the iron core 24 attracts the flat plate part 16*a* and the armature 16 rotates under a condition that the projection parts 34*c* and the cutout parts 16*e* act as a supporting point. With the rotation of the armature 16, the suspended part 16*b* and the movable spring 18 rotate toward a fixed terminal 22 side, and then the movable contacts 36*a* and 36*b* are in contact with the corresponding fixed contacts 38*a* and 38*b*, respectively. When a voltage is applied to the fixed terminal 22*b* as a positive pole side in a state where the movable contacts 36*a* and 36*b* are in contact with the fixed contacts 38*a* and 38*b*, the current flows in the fixed terminal 22*b*, the fixed contact 38*b*, the movable contact 36*b*, the conductive plate 40, the movable spring 18, the movable contact 36*a*, the fixed contact 38*a* and the fixed terminal 22*a* in this order as illustrated in FIG. 7A. Here, the current flows in both of the conductive plate 40 and the movable spring 18 between the movable contacts 36*a* and 36*b*. When the current flowing in the coil 30 is shut off, the restoring force of the hinge spring 14 rotates the armature 16 anticlockwise illustrated in FIG. 7B. Due to the rotation of the armature 16, the movable contacts 36*a* and 36*b* start to separate from the fixed contacts 38*a* and 38*b*, respectively. However, since an arc occurs between the fixed contacts 38*a* and 38*b* and the movable contacts 36*a* and 36*b*, the current flowing between the movable contact 36*a* and the fixed contact 38*a* and the current flowing between the movable contact 36*b* and the fixed contact 38*b* are not completely shut off.

In the relay 1 illustrated in FIGS. 7A to 7C, a direction of a magnetic field is directed from the fixed terminal 22*a* to the fixed terminal 22*b*, as illustrated in FIG. 7B. Therefore, an arc generated between the movable contact 36*a* and the fixed contact 38*a* is extended to a space in a lower direction toward the base 28 by Lorentz force as indicated by an arrow A of FIG. 7B and is extinguished. On the other hand, an arc generated between the movable contact 36*b* and the fixed contact 38*b* is extended to a space in an upper direction separated from the base 28 by the Lorentz force as indicated by an arrow B of FIG. 7C and is extinguished.

Figure 8A:
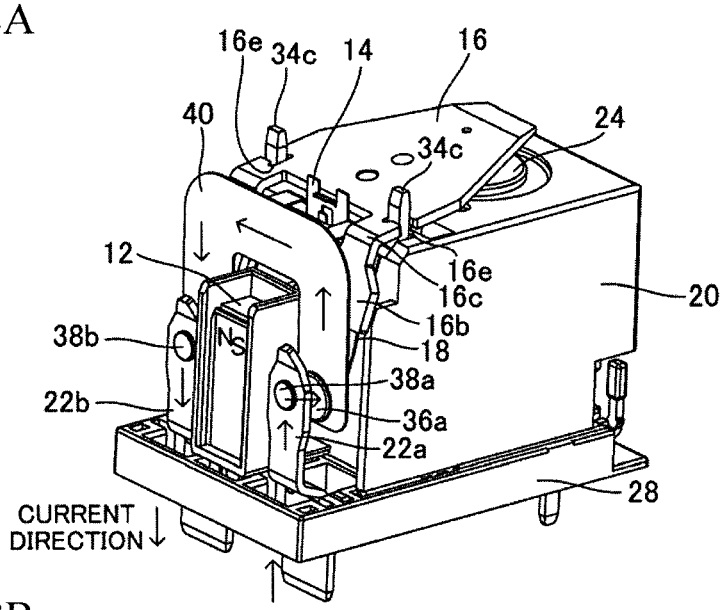
FIG. 8A is a diagram schematically illustrating a direction of a current flowing into the relay 1.
Figure 8B:
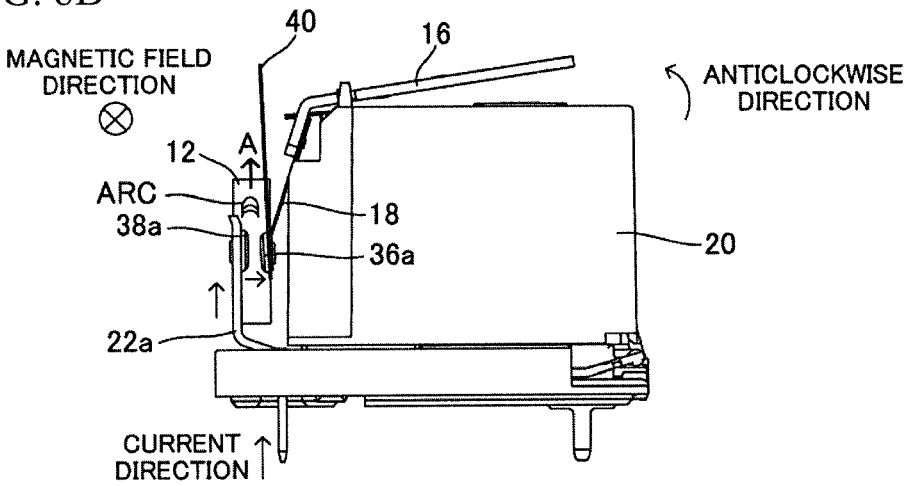
FIG. 8B is a diagram illustrating an arc-extinguishing state viewed from the fixed terminal 22*a* side.
Figure 8C:
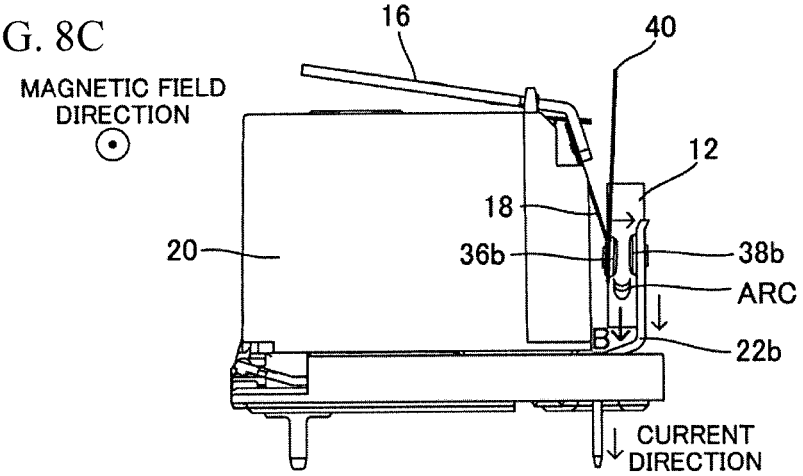
FIG. 8C is a diagram illustrating an arc-extinguishing state viewed from the fixed terminal 22*b* side.

FIG. 8A schematically illustrates the direction of the current flowing into the relay 1. FIG. 8B illustrates an arc-extinguishing state viewed from the fixed terminal 22*a* side. FIG. 8C illustrates an arc-extinguishing state viewed from the fixed terminal 22*b* side. Here, the direction of the current is opposite to that of the current of FIGS. 7A to 7C.

In FIG. 8A, any one of the fixed terminals 22*a* and 22*b* is connected to the power supply side, and the other is connected to the load side, as with FIG. 7A. When the voltage is applied to the fixed terminal 22*a* as the positive pole side in the state where the movable contacts 36*a* and 36*b* are in contact with the fixed contacts 38*a* and 38*b*, the current flows in the fixed terminal 22*a*, the fixed contact 38*a*, the movable contact 36*a*, the conductive plate 40, the movable spring 18, the movable contact 36*b*, the fixed contact 38*b* and the fixed terminal 22*b* in this order as illustrated in FIG. 8A. When the current flowing in the coil 30 is shut off, the restoring force of the hinge spring 14 rotates the armature 16 anticlockwise illustrated in FIG. 8B, and the movable contacts 36*a* and 36*b* separate from the fixed contacts 38*a* and 38*b*, respectively.

Also in the relay 1 illustrated in FIGS. 8A to 8C, the direction of the magnetic field is directed from the fixed terminal 22*a* to the fixed terminal 22*b*. Therefore, the arc generated between the movable contact 36*a* and the fixed contact 38*a* is extended to the space in the upper direction by Lorentz force as indicated by an arrow A of FIG. 8B and is extinguished. On the other hand, the arc generated between the movable contact 36*b* and the fixed contact 38*b* is extended to the space in the lower direction toward the base 28 by the Lorentz force as indicated by an arrow B of FIG. 8C and is extinguished.

Therefore, according to the relay 1 of the present embodiment, regardless of the direction of the current flowing between the movable contact 36*a* and the fixed contact 38*a* and between the movable contact 36*b* and the fixed contact 38*b*, the arc generated between the movable contact 36*a* and the fixed contact 38*a* and the arc generated between the movable contact 36*b* and the fixed contact 38*b* can be extended to the opposite spaces at the same time, respectively, and be extinguished.

Figure 9A:
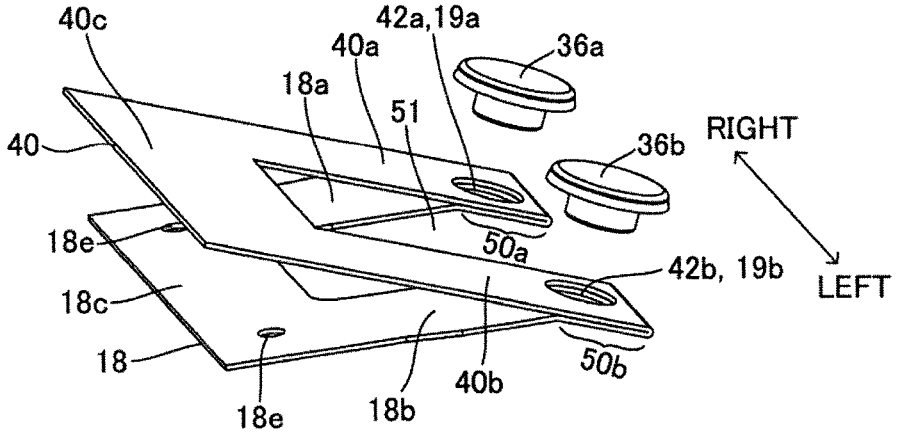
FIG. 9A is a diagram of a first variation of the movable spring 18 and the conductive plate 40.
Figure 9B:
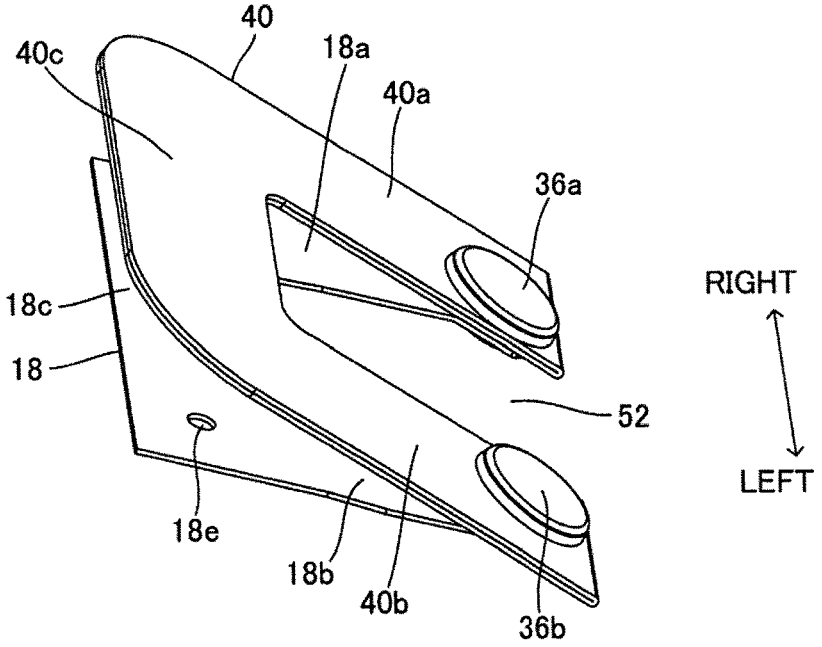
FIG. 9B is a diagram of a second variation of the conductive plate 40.

FIG. 9A is a diagram of a first variation of the movable spring 18 and the conductive plate 40. FIG. 9B is a diagram of a second variation of the conductive plate 40.

The movable spring 18 and the conductive plate 40 may be integrally formed by bending a metal plate of which a rectangular through-hole 51 is formed in the center, as illustrated in FIG. 9A. In this case, the through-holes 42*a* and 19*a* and the through-holes 42*b* and 19*b* are formed on edge parts 50*a* and 50*b* each of which is folded and superimposed, respectively. The through-holes 42*a* and 19*a* and the through-holes 42*b* and 19*b* are formed at a time by press processing. Since the movable spring 18 and the conductive plate 40 is formed with a single conductive plate, it is possible to reduce the number of parts and make assembly process more efficient. Moreover, since the through-holes 42*a* and 19*a* and the through-holes 42*b* and 19*b* are formed at a time on the edge parts 50*a* and 50*b* each of which is folded and superimposed, it is possible to avoid the displacement of the through-holes 42*a* and 19*a* and the displacement of the through-holes 42*b* and 19*b* and make assembly process more efficient.

By bending a thin metal plate of which a rectangular through-hole 52 is formed in the center, a two-ply conductive plate 40 may be formed as illustrated in FIG. 9B. It is possible to suppress the increase in a rigidity and improve the current-carrying capacity as compared with a single thick conductive plate.

Figure 10A:
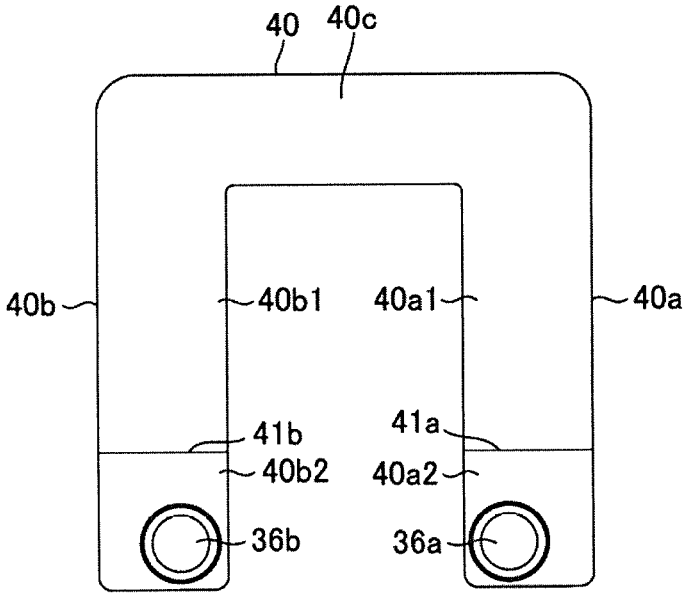
FIG. 10A is a diagram of a third variation of the conductive plate 40.
Figure 10B:
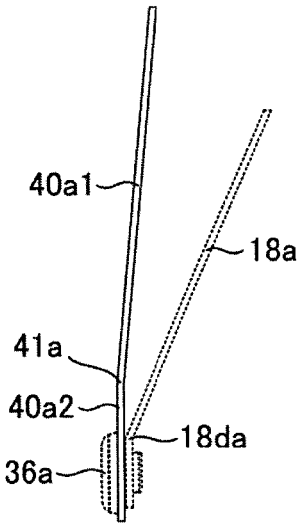
FIG. 10B is a side view of the conductive plate 40 of FIG. 10A.
Figure 10C:
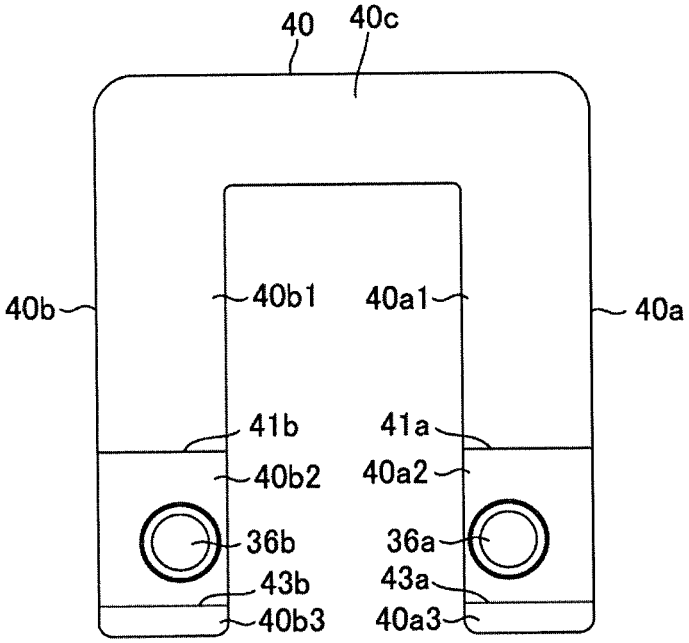
FIG. 10C is a diagram of a fourth variation of the conductive plate 40.
Figure 10D:
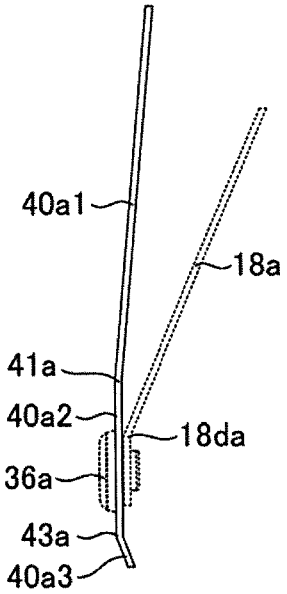
FIG. 10D is a side view of the conductive plate 40 of FIG. 10C.

FIG. 10A is a diagram of a third variation of the conductive plate 40. FIG. 10B is a side view of the conductive plate 40 of FIG. 10A. FIG. 10C is a diagram of a fourth variation of the conductive plate 40. FIG. 10D is a side view of the conductive plate 40 of FIG. 10C.

As illustrated in FIGS. 10A and 10B, the first leg piece 40*a* and the second leg piece 40*b* of the conductive plate 40 may be bent at positions 41*a* and 41*b* where the movable contacts 36*a* and 36*b* fixed by caulking do not protrude upward. Here, a part of the first leg piece 40*a* that is lower than the position 41*a* is defined as a lower part 40*a*2. A part of the first leg piece 40*a* that is upper than the position 41*a* is defined as an upper part 40*a*1. Similarly, a part of the second leg piece 40*b* that is lower than the position 41*b* is defined as a lower part 40*b*2. A part of the second leg piece 40*b* that is upper than the position 41*b* is defined as an upper part 40*b*1. The lower parts 40*a*2 and 40*b*2 serve as a first domain, and the upper parts 40*a*1 and 40*b*1 serve as a second domain adjacent to the first domain.

The upper parts 40*a*1 and 40*b*1 and the coupling part 40*c* are bent in a direction away from the fixed contact 38*a* and 38*b* with which the movable contacts 36*a* and 36*b* are in contact. In this case, since clearances between the fixed terminals 22*a* and 22*b* and the conductive plate 40 are gradually spread upward from the fixed terminal 22*a* and 22*b*, the arc can be extinguished efficiently while being moved to the space in the upper direction.

Moreover, as illustrated in FIGS. 10C and 10D, the first leg piece 40*a* and the second leg piece 40*b* of the conductive plate 40 may be bent at positions 43*a* and 43*b* where the movable contacts 36*a* and 36*b* do not protrude downward. Here, the lower part 40*a*2 corresponds to a part between the positions 41*a* and 43*a*, and the lower part 40*b*2 corresponds to a part between the positions 41*b* and 43*b*. A part of the first leg piece 40*a* that is lower than the position 43*a* is defined as a lowermost part 40*a*3. A part of the second leg piece 40*b* that is lower than the position 43*b* is defined as a lowermost part 40*b*3.

The lowermost parts 40*a*3 and 40*b*3 are bend in a direction away from the fixed contacts 38*a* and 38*b*, respectively. In this case, since the clearances between the fixed terminals 22*a* and 22*b* and the conductive plate 40 are gradually spread downward from the fixed terminal 22*a* and 22*b*, the arc can be extinguished efficiently while being moved to the space in the lower direction by the lowermost parts 40*a*3 and 40*b*3.

As described above, in the present embodiment, the conductive plate 40 is disposed between the head part 361 and the movable spring 18, and in the radial direction of the through-holes 19*a* and 19*b* of the movable spring 18 and the through-holes 42*a* and 42*b* of the conductive plate 40, the head part 361 does not protrude from the outer edge of the conductive plate 40 even when protrudes from the outer edge of the lower parts 18*a*2 and 18*b*2. Therefore, since the conductive plate 40 with which the whole of the head part 361 is in contact is disposed between the head part 361 and the lower parts 18*a*2 and 18*b*2 of the movable spring 18, it is possible to efficiently convey the current and the heat from the movable contact 36*a* and 36*b* to the conductive plate 40 and increase the current-carrying capacity. Moreover, the leg part 362 fixed by caulking does not protrude from the outer edge of the lower parts 18*a*2 and 18*b*2 in the radial direction of the through-holes 19*a* and 19*b*.

Since the conductive plate 40 that increases the current-carrying capacity is provided, a freedom degree of the design of the spring load is improved without considering the current-carrying capacity of the movable spring 18. Even if there is a structural constraint that prohibit changing the size of the movable spring 18, it is possible to improve the current-carrying capacity by providing the conductive plate 40. Moreover, since the conductive plate 40 is made of a material having the high thermal conductivity, it is possible to efficiently cool the heat of the arc and improve the opening and closing performance of the movable contact 36*a* and 36*b*.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

a fixed terminal that includes a fixed contact;

a movable spring that includes a movable piece on which a first through-hole is formed;

a conductive plate that includes a second through-hole;

a movable contact that includes a head part that is in contact with and is separated from the fixed contact, and a leg part that is inserted into the first through-hole and the second through-hole;

wherein the conductive plate is disposed between the head part and the movable spring, in a radial direction of the first through-hole and the second through-hole, the head part does not protrude from an outer edge of the conductive plate but protrudes from the outer edge of the movable piece.

2. The electromagnetic relay as claimed in claim 1, wherein the conductive plate has a higher conductivity and a higher thermal conductivity than the movable spring.

3. The electromagnetic relay as claimed in claim 1, wherein the conductive plate is made of a two-ply conductive plate.

4. The electromagnetic relay as claimed in claim 1, wherein the conductive plate includes a first domain on which the movable contact is disposed, and a second domain adjacent to the first domain, the second domain is bent in a direction away from the fixed contact.

5. The electromagnetic relay as claimed in claim 1, wherein the conductive plate is formed integrally with the movable spring.

6. The electromagnetic relay as claimed in claim 1, wherein the fixed terminal includes a first fixed terminal and a second fixed terminal each of which includes the fixed contact, the movable spring includes a first movable piece and a second movable piece on each of which the first through-hole is formed;

the electromagnetic relay further includes:

an electromagnet device that drives an armature to be coupled with the movable spring, and a cover that covers the electromagnet device.

* * * * *